US009335052B2

(12) United States Patent
DiCintio

(10) Patent No.: US 9,335,052 B2
(45) Date of Patent: May 10, 2016

(54) CROSS-FIRE TUBE MOUNTING ASSEMBLY FOR A GAS TURBINE ENGINE COMBUSTOR

(71) Applicant: General Electric Company, Schenectady, NY (US)

(72) Inventor: Richard Martin DiCintio, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 768 days.

(21) Appl. No.: 13/672,248

(22) Filed: Nov. 8, 2012

(65) Prior Publication Data

US 2014/0123619 A1 May 8, 2014

(51) Int. Cl.

| | |
|---|---|
| ***F23R 3/48*** | (2006.01) |
| ***F23R 3/60*** | (2006.01) |
| *F23C 6/02* | (2006.01) |
| *F16L 37/088* | (2006.01) |

(52) U.S. Cl.

CPC ... *F23R 3/48* (2013.01); *F23R 3/60* (2013.01); *F16L 37/088* (2013.01); *F23C 6/02* (2013.01); *Y10T 29/49323* (2015.01)

(58) Field of Classification Search

CPC ..... F23R 3/48; F23R 3/46; F23R 3/60; F16L 37/088; F16L 37/0841; F16L 37/0844; F23C 6/02; F23C 5/02; F23G 2202/103; F23M 3/14; F23M 5/04

USPC ..... 403/365, 366, 372, 373; 431/202, 343, 431/349

See application file for complete search history.

(56) References Cited

U.S. PATENT DOCUMENTS

| | | | | | |
|---|---|---|---|---|---|
| 2,679,136 | A * | 5/1954 | Gaubatz | F23R 3/48 | 60/39.37 |
| 2,722,803 | A * | 11/1955 | Travers | F23R 3/48 | 60/39.37 |
| 2,832,195 | A * | 4/1958 | Weissborn, Jr. | F23R 3/48 | 285/302 |
| 3,991,560 | A * | 11/1976 | DeCorso | F23R 3/48 | 60/39.37 |
| 4,249,372 | A | 2/1981 | White | | |
| 5,219,256 | A * | 6/1993 | Ford | F23R 3/48 | 411/517 |
| 5,361,577 | A * | 11/1994 | Cromer | F23R 3/48 | 285/227 |
| 7,712,302 | B2 * | 5/2010 | Nichols | F23R 3/48 | 60/39.821 |
| 2004/0172952 | A1 * | 9/2004 | Sileo | F02C 7/264 | 60/800 |
| 2011/0067406 | A1 * | 3/2011 | Widener | F23R 3/48 | 60/754 |
| 2014/0137536 | A1 * | 5/2014 | Cloninger | F23R 3/48 | 60/39.37 |
| 2014/0144122 | A1 * | 5/2014 | Overby | F23R 3/48 | 60/39.37 |

* cited by examiner

*Primary Examiner* — William H Rodriguez

(74) *Attorney, Agent, or Firm* — Ernest G. Cusick; Frank A. Landgraff

(57) ABSTRACT

According to one aspect of the invention, a combustor assembly for a pair of adjacent combustors includes a first passage formed in a liner of a first combustor and a flow sleeve disposed outside the liner of the first combustor, wherein the flow sleeve includes a window and a second passage aligned with the first passage. The assembly also includes a cross-fire tube disposed in the first passage to provide fluid communication between the first combustor and a second combustor and a retention clip disposed through the window to urge the cross-fire tube against an outer surface of the liner to enable the cross-fire tube to receive fluid through the first passage.

16 Claims, 3 Drawing Sheets

CROSS-FIRE TUBE MOUNTING ASSEMBLY FOR A GAS TURBINE ENGINE COMBUSTOR

BACKGROUND OF THE INVENTION

The subject matter disclosed herein relates to turbine engines. More particularly, the subject matter relates to cross-fire tubes located in combustor assemblies.

In gas turbine engines, a combustor converts chemical energy of a fuel and air-fuel mixture into thermal energy. The thermal energy is conveyed by a fluid, often air from a compressor, via a transition piece to a turbine where the thermal energy is converted to mechanical energy. These fluids flow downstream to one or more turbines that extract energy therefrom to produce the mechanical energy output as well as power to drive the compressor.

A combustion system for a gas turbine engine typically includes a number of generally cylindrical combustors disposed about the turbine in an annular arrangement, with each combustor supplying a motive fluid to an arcuate section of a turbine nozzle. In some cases, short conduits or "cross fire tubes" interconnect the combustion chambers of adjoining combustors, where the cross fire tubes provide for the ignition of fuel in one chamber from ignited fuel in an adjacent chamber in order to obviate the need for providing a spark plug for each combustor.

Air may be directed between a flow sleeve and liner of the combustor assembly, where the air is received at a head end of the combustor is used for combustion and also cools combustion components it flows across. In some cases, cross fire tube assemblies may interfere or disrupt air flow to the combustor head end and, thus, adversely affect combustion and turbine efficiency.

BRIEF DESCRIPTION OF THE INVENTION

According to one aspect of the invention, a combustor assembly for a pair of adjacent combustors includes a first passage formed in a liner of a first combustor and a flow sleeve disposed outside the liner of the first combustor, wherein the flow sleeve includes a window and a second passage aligned with the first passage. The assembly also includes a cross-fire tube disposed in the first passage to provide fluid communication between the first combustor and a second combustor and a retention clip disposed through the window to urge the cross-fire tube against an outer surface of the liner to enable the cross-fire tube to receive fluid through the first passage.

According to another aspect of the invention, a method for assembly of a combustor apparatus includes positioning a cross-fire tube to provide fluid communication between a first combustion chamber of a first combustor and a second combustion chamber of a second combustor, abutting an end of the cross-fire tube against an outer surface of a liner of the first combustion chamber, where the end of the cross-fire tube is concentric with a first passage in the liner, placing a retention clip through a window in a flow sleeve of the first combustion chamber, receiving the cross-fire tube within a first portion of the retention clip disposed radially outside of the flow sleeve and coupling a second portion of the retention clip to a flange of the flow sleeve, thereby urging the end of the cross-fire tube against the outer surface of the liner.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
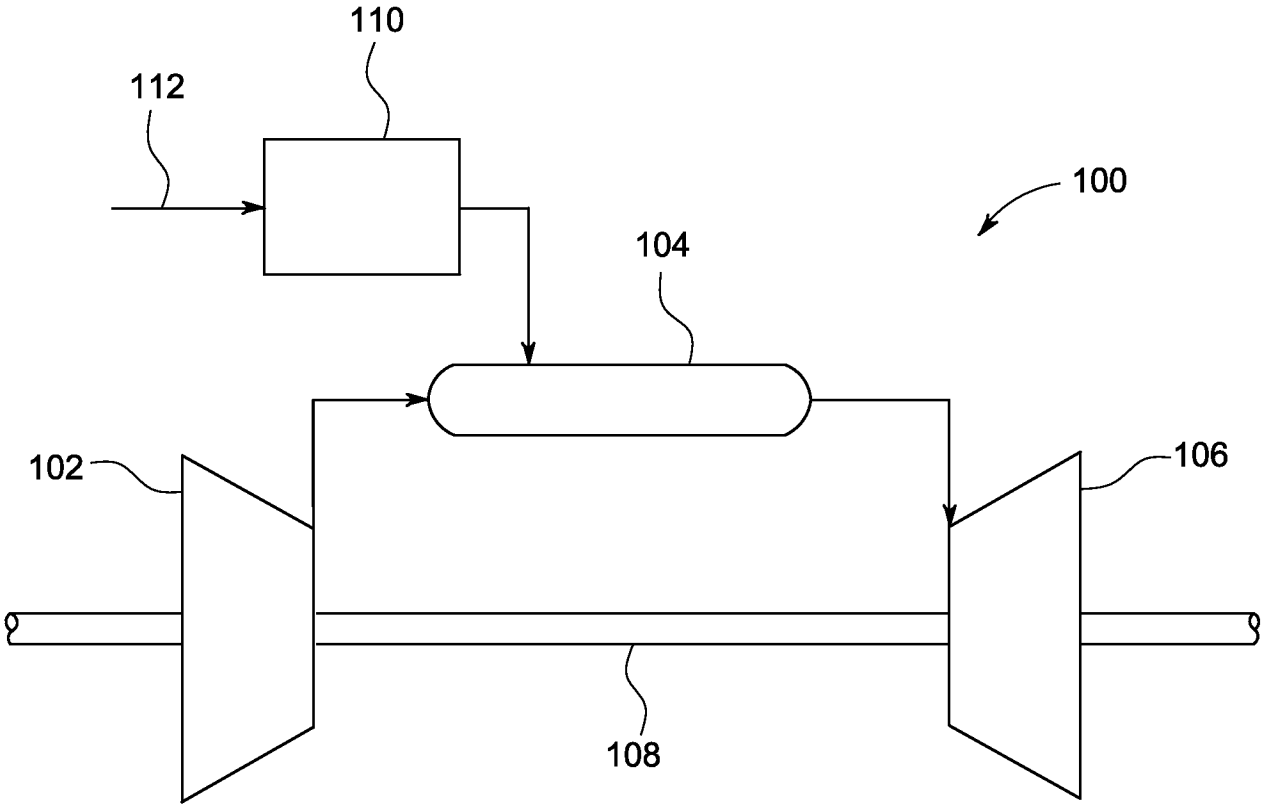
FIG. 1 is a schematic diagram of an embodiment of a gas turbine system.

FIG. 1 is a schematic diagram of an embodiment of a gas turbine system 100. The system 100 includes a compressor 102, a combustor 104, a turbine 106, a shaft 108 and a fuel nozzle 110. In an embodiment, the system 100 may include a plurality of compressors 102, combustors 104, turbines 106, shafts 108 and fuel nozzles 110. As depicted, the compressor 102 and turbine 106 are coupled by the shaft 108. The shaft 108 may be a single shaft or a plurality of shaft segments coupled together to form shaft 108.

In an aspect, the combustor 104 uses liquid and/or gas fuel, such as natural gas or a hydrogen rich synthetic gas, to run the turbine engine. For example, fuel nozzles 110 are in fluid communication with a fuel supply 112 and pressurized air from the compressor 102. The fuel nozzles 110 create an air-fuel mix, and discharge the air-fuel mix into the combustor 104, thereby causing a combustion that creates a hot pressurized exhaust gas. The combustor 104 directs the hot pressurized exhaust gas through a transition piece into a turbine nozzle (or "stage one nozzle"), causing turbine 106 rotation as the gas exits the nozzle or vane and gets directed to the turbine bucket or blade. The rotation of turbine 106 causes the shaft 108 to rotate, thereby compressing the air as it flows into the compressor 102.

Figure 2:
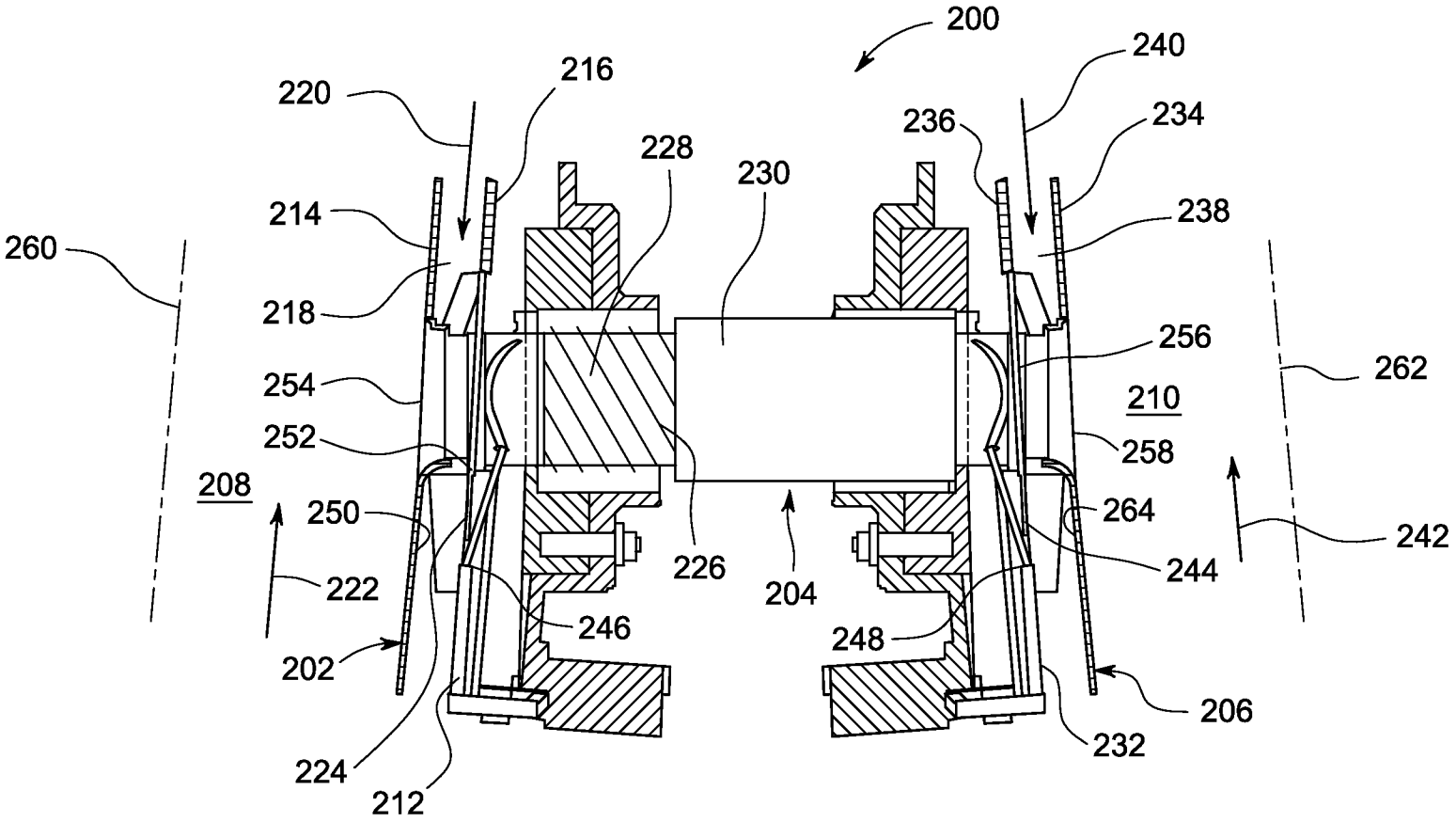
FIG. 2 is a sectional view of a portion of an embodiment of a combustor assembly.
Figure 3:
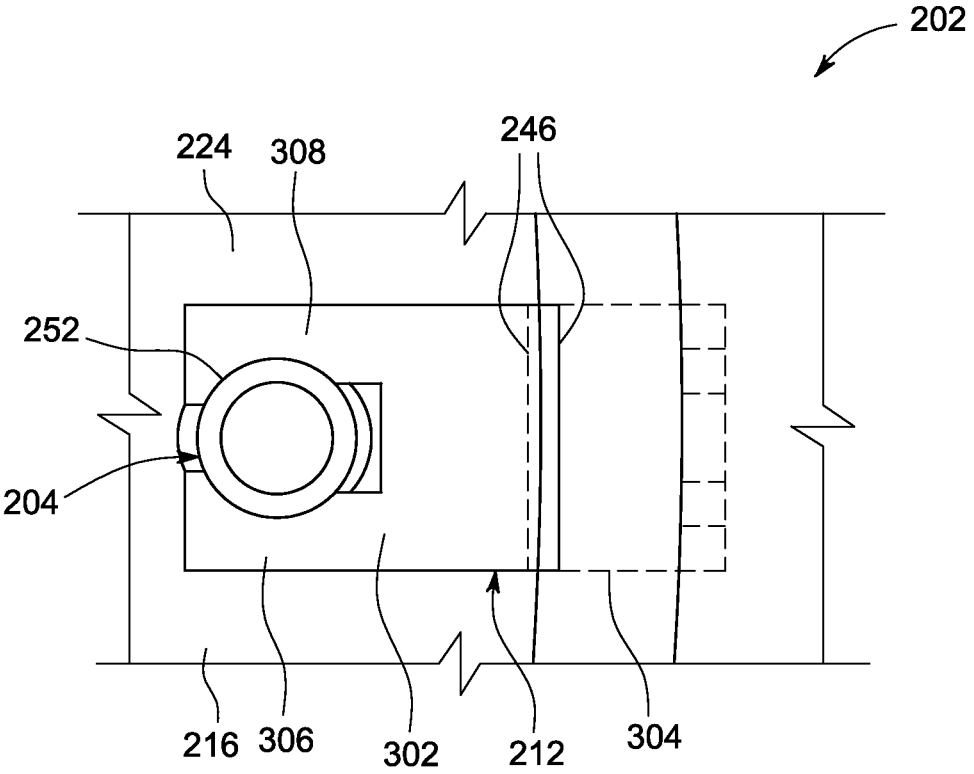
FIG. 3 is a detailed end view of a portion of a combustor and a cross fire tube according to one embodiment.
Figure 4:
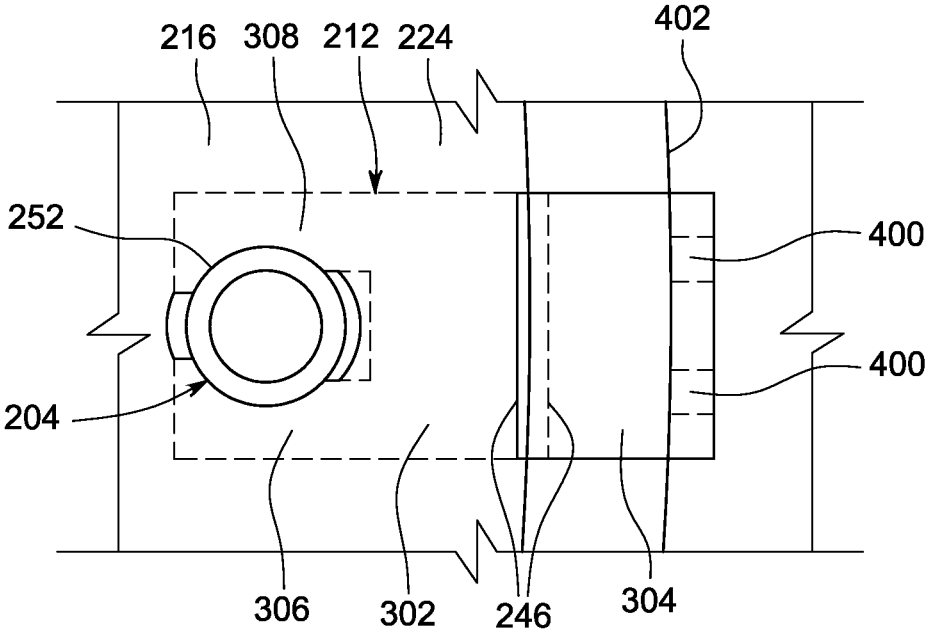
FIG. 4 is a detailed end view of the portion of the combustor and the cross fire tube shown in FIG. 3.

In embodiments, a combustion system includes a plurality of cylindrical combustors circumferentially arranged about a turbine. One or more of the combustors is provided with a spark plug assembly for igniting a mixture of fuel and air in a combustion chamber therein. Cross-ignition assemblies are positioned between adjacent combustors to provide fluid communication between combustion chambers, as shown in FIGS. 2-4. The cross fire tubes are conduits between adjacent combustors to enable combustion gases of one combustor to ignite a fuel-air mixture in the combustion chamber of an adjacent combustor. This arrangement enables a reduced amount of spark assemblies needed for the combustion system.

In some embodiments, the cross fire tubes are coupled to a liner and/or flow sleeve of each combustor, where the coupling prevents movement of the cross fire tubes and leakage of air from outside the liner into the combustion chamber. Embodiments of the cross fire assemblies provide improved coupling and positioning of the cross fire tubes, thus reducing or eliminating a likelihood of air leaks into combustion chambers. In addition, an embodiment of a retention clip is provided that couples and retains the cross fire tube in place, where the retention does not substantially disrupt the air flow through an annulus formed between the liner and flow sleeve.

As used herein, "downstream" and "upstream" are terms that indicate a direction relative to the flow of working fluid through the turbine. As such, the term "downstream" refers to a direction that generally corresponds to the direction of the flow of working fluid, and the term "upstream" generally refers to the direction that is opposite of the direction of flow of working fluid. The term "radial" refers to movement or position perpendicular to an axis or center line. It may be useful to describe parts that are at differing radial positions with regard to an axis. In this case, if a first component resides closer to the axis than a second component, it may be stated herein that the first component is "radially inward" of the second component. If, on the other hand, the first component resides further from the axis than the second component, it can be stated herein that the first component is "radially outward" or "outboard" of the second component. The term "axial" refers to movement or position parallel to an axis. Finally, the term "circumferential" refers to movement or position around an axis. Although the following discussion primarily focuses on gas turbines, the concepts discussed are not limited to gas turbines and may apply to any suitable rotating machinery, including steam turbines. Accordingly, the discussion herein is directed to gas turbine embodiments, but may apply to steam turbines and other turbomachinery.

FIG. 2 is a sectional view of a portion of an exemplary combustor assembly 200. The combustor assembly 200 includes a combustor 202, a cross fire tube 204 and a combustor 206. The cross fire tube 204 provides fluid communication between a combustion chamber 208 and an adjacent combustion chamber 210, where the cross fire tube 204 allows ignition in one combustion chamber to cause ignition in the adjacent combustion chamber. The cross fire tube 204 also provides a pressure balancing between the combustion chambers, thus helping maintain combustion pressures at desirable levels. In an embodiment, the cross fire tube 204 is disposed or positioned in a passage 252 in the flow sleeve 216 and in a passage 254 in the liner 214, where the cross fire tube 204 abuts or is positioned against an outer surface 250 of the liner 214 to enable fluid communication from within the cross fire tube 204 to combustion chamber 208. In embodiments, the passage 254 is aligned with passage 252 for positioning of the cross fire tube 204 therein, thus enabling the tube to be concentric with passage 254 when installed. In an embodiment, the cross fire tube 204 is coupled and retained in position relative to the combustor 202 by a retention clip 212, where the retention clip 212 is disposed through a window 246 in a flow sleeve 216 of the combustor 202. The flow sleeve 216 and a liner 214 form an annulus 218 that receives an air flow 220. The air flow 220 flows toward a head end of the combustor 202, where the head end includes a nozzle assembly that receives the air flow 220 and mixes it with a fuel. The air-fuel mixture is ignited and causes a hot gas flow 222 (also referred to as "combustion gas flow") to be directed downstream to drive rotation of a turbine (not shown). The cross fire tube 204 allows ignition from the combustor 202 to communicate to the adjacent combustor 206 and, thus, cause ignition of an air-fuel mixture in the adjacent combustor. Other embodiments of combustor assemblies without cross fire tubes have an ignition source (e.g., spark ignition device) in each chamber. Embodiments with cross fire tubes allow for fewer ignition sources in the combustor assembly and, thus, simplify the assembly and reduce costs.

In an embodiment, the cross fire tube 204 includes a first tube 228 and a second tube 230, where first and second tubes telescope relative to each other to provide a simplified installation and allow the tube to adjust to variations in assemblies. A spring 226 or other biasing member may also provide retention of the cross fire tube 204 in position against components of the combustors 202 and 206. For example, the spring 226 urges the cross fire tube 204 against the radially outer surface 250 of the liner 214. In an embodiment, the spring 226 positions and retains the cross fire tube 204 in addition to the retention clip 212. In another embodiment, the cross fire tube is retained only by retention clips.

Still referring to FIG. 2, in an embodiment, the cross fire tube 204 is coupled and retained in position relative to the combustor 206 by a retention clip 232, where the retention clip 232 is disposed through a window 248 in a flow sleeve 236 of the combustor 206. The flow sleeve 236 and a liner 234 form an annulus 238 that receives an air flow 240. The air flow 240 flows toward a head end of the combustor 206, where the head end includes a nozzle assembly that receives the air flow 240 and mixes it with a fuel. The air-fuel mixture is ignited and causes a hot gas flow 242 to be directed downstream to drive rotation of a turbine (not shown). In an embodiment, the cross fire tube 204 is disposed or positioned in a passage 256 in the flow sleeve 236 and in a passage 258 in the liner 234, where the cross fire tube 204 abuts or is positioned against an outer surface 264 of the liner 234 to enable fluid communication from within the cross fire tube 204 to combustion chamber 210. In embodiments, the passage 258 is aligned with passage 256 for positioning of the cross fire tube 204 therein. When installed, the retention clip 232 substantially covers the window 248 in flow sleeve 236 to reduce or prevent leakage. Similarly, the installed retention clip 212 substantially covers the window 246 in flow sleeve 216 to reduce or prevent leakage.

As depicted, the portion of the retention clip 232 located in the annulus 238 substantially conforms to a radially inner surface 244 (i.e., radially inner with respect to an axis 262 of combustor 206) of the flow sleeve 236. Similarly, the portion of the retention clip 212 located in the annulus 218 substantially conforms to a radially inner surface 224 (i.e., radially inner with respect to an axis 260 of combustor 202) of the flow sleeve 216. By substantially conforming to the inner surfaces of the respective flow sleeves, the retention clips 212 and 232 do not substantially disrupt the air flows 220 and 240, respectively, directed to head ends of respective combustors 202 and 206. As discussed herein, air flow is not substantially disrupted when air flows along a path without substantial turbulence that can lead to undesirable performance of the combustor. Accordingly, reducing the likelihood of air flow 220, 240 disruption can lead to improved combustor performance. In an embodiment, both ends of the cross fire tube 104 are positioned and retained in the same arrangement and, therefore, for ease of explanation will only be described with respect to the end positioned in combustor 202 in FIGS. 3 and 4.

FIG. 3 is a detailed end view of a portion of the combustor 202 and the cross fire tube 204 according to one embodiment. The depicted view shows the combustor 202 and the radially outer surface 224 of the flow sleeve 216 when viewed in a radial direction (i.e., perpendicular to axis 260), where certain components from the combustor 202 and cross fire tube 204 assembly are removed for clarity, such as the liner 214. The retention clip 212 disposed through the window 246 in the flow sleeve 216. The retention clip 212 substantially covers the window 246 when installed as shown, thus reducing the incidence of air flow 220 leakage. In an embodiment, a first portion 302 of the retention clip 212 is positioned radially outside the flow sleeve 216 and retains the cross fire tube 204 via prongs 306 and 308 configured to compressively couple to the cross fire tube 204 while the retention clip 212 urges the cross fire tube 204 against the radially outer surface 250 of the liner 214. In an embodiment, once the retention clip 212 is installed, it substantially reduces leakage of hot gas flow 222 into the annulus 218. In addition, the retention clip 212 also includes a second portion 304 disposed in the annulus 218 and shown in FIG. 4.

FIG. 4 is a detailed end view of a portion of the combustor 202 and the cross fire tube 204 according to one embodiment. The depicted view shows the combustor 202 and the radially inner surface 224 of the flow sleeve 216 when viewed in a radial direction (i.e., perpendicular to axis 260) from the annulus 218. Certain components from the combustor 202 and cross fire tube 204 assembly are removed for clarity, such as the liner 214. As depicted, the second portion 304 of the retention clip 212 substantially conforms to the radially inner surface 224 of the flow sleeve 216 to provide substantially no disruption of air flow 220 towards the head end of the combustor 202. In an embodiment, the second portion 304 of the retention clip 212 is coupled, via bolts 400 or other suitable coupling mechanism, to a flange 402 of the flow sleeve 216. The retention clip 212 may be formed via any suitable method, such stamping and/or machining a sheet of a suitable material, such as a stainless steel alloy.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A combustor assembly for a pair of adjacent combustors, comprising:

a first passage formed in a liner of a first combustor;

a flow sleeve disposed outside the liner of the first combustor, wherein the flow sleeve comprises a window and a second passage aligned with the first passage;

a cross-fire tube disposed in the first passage to provide fluid communication between the first combustor and a second combustor; and a retention clip disposed through the window to urge the cross-fire tube against an outer surface of the liner to enable the cross-fire tube to receive fluid through the first passage, wherein a first portion of the retention clip conforms to a radially inner surface of the flow sleeve, and wherein a second portion of the retention clip is coupled to a flange of the flow sleeve.

2. The combustor assembly of claim 1, wherein an annulus formed between the liner and the flow sleeve receives an air flow towards a head end of the first combustor and wherein the retention clip does not substantially disrupt the air flow through the annulus.

3. The combustor assembly of claim 1, wherein the retention clip comprises a pair of parallel prongs configured to receive the cross-fire tube.

4. A combustor assembly for a pair of adjacent combustors, comprising:

a first passage formed in a liner of a first combustor;

a flow sleeve disposed outside the liner of the first combustor, wherein the flow sleeve comprises a window and a second passage aligned with the first passage;

a cross-fire tube disposed in the first passage to provide fluid communication between the first combustor and a second combustor; and a retention clip disposed through the window to urge the cross-fire tube against an outer surface of the liner to enable the cross-fire tube to receive fluid through the first passage, further comprising a spring disposed about the cross-fire tube to provide retention of the cross-fire tube against the outer surface of the liner.

5. A method for assembly of a combustor apparatus, the method comprising:

positioning a cross-fire tube to provide fluid communication between a first combustion chamber of a first combustor and a second combustion chamber of a second combustor;

abutting an end of the cross-fire tube against an outer surface of a liner of the first combustion chamber, where the end of the cross-fire tube is concentric with a first passage in the liner;

placing a retention clip through a window in a flow sleeve of the first combustion chamber;

receiving the cross-fire tube within a first portion of the retention clip disposed radially outside of the flow sleeve; and coupling a second portion of the retention clip to a flange of the flow sleeve, thereby urging the end of the cross-fire tube against the outer surface of the liner, wherein coupling the second portion of the retention clip comprises conforming the second portion of the retention clip to a radially inner surface of the flow sleeve.

6. The method of claim 5, comprising forming an annulus between the liner and the flow sleeve that receives an air flow towards a head end of the first combustor and wherein the retention clip does not substantially disrupt the air flow through the annulus.

7. The method of claim 5, wherein receiving the cross-fire tube within the first portion of the retention clip comprises receiving the cross-fire tube within a pair of parallel prongs of the retention clip configured to receive the cross-fire tube.

8. The method of claim 5, wherein coupling the second portion of the retention clip comprises reducing leakage of an air flow out of an annulus formed between the liner and the flow sleeve.

9. The method of claim 5, wherein receiving the cross-fire tube within the first portion of the retention clip comprises receiving the cross-fire tube within a pair of parallel prongs configured to receive the cross-fire tube.

10. A method for assembly of a combustor apparatus, the method comprising:

positioning a cross-fire tube to provide fluid communication between a first combustion chamber of a first combustor and a second combustion chamber of a second combustor;

abutting an end of the cross-fire tube against an outer surface of a liner of the first combustion chamber, where the end of the cross-fire tube is concentric with a first passage in the liner;

placing a retention clip through a window in a flow sleeve of the first combustion chamber;

receiving the cross-fire tube within a first portion of the retention clip disposed radially outside of the flow sleeve; and coupling a second portion of the retention clip to a flange of the flow sleeve, thereby urging the end of the cross-fire tube against the outer surface of the liner, further comprising:

disposing a spring about the cross-fire tube to urge the cross-fire tube against the outer surface of the liner; and positioning the cross-fire tube through a second passage in the flow sleeve.

11. A combustor apparatus comprising:

a first combustion chamber in a first combustor;

a second combustion chamber in a second combustor adjacent to the first combustor;

a cross-fire tube positioned between the first and second combustors to provide fluid communication between the first combustion chamber and the second combustion chamber; and a retention clip, the retention clip coupled to the cross-fire tube and configured to urge the cross-fire tube against an outer surface of a liner of the first combustor, wherein a portion of the retention clip conforms to a radially inner surface of a flow sleeve of the first combustor, wherein a second portion of the retention clip conforms to a radially outer surface of the flow sleeve.

12. The combustor apparatus of claim 11, wherein the retention clip is disposed through a window in the flow sleeve.

13. The combustor apparatus of claim 11, wherein an annulus formed between the liner and the flow sleeve receives an air flow towards a head end of the first combustor and wherein the retention clip does not substantially disrupt the air flow through the annulus.

14. The combustor apparatus of claim 11, wherein the retention clip comprises a pair of parallel prongs configured to receive the cross-fire tube.

15. A combustor apparatus comprising:

a first combustion chamber in a first combustor;

a second combustion chamber in a second combustor adjacent to the first combustor;

a cross-fire tube positioned between the first and second combustors to provide fluid communication between the first combustion chamber and the second combustion chamber; and a retention clip, the retention clip coupled to the cross-fire tube and configured to urge the cross-fire tube against an outer surface of a liner of the first combustor, wherein a portion of the retention clip conforms to a radially inner surface of a flow sleeve of the first combustor, further wherein a first portion of the retention clip is coupled to a flange of the flow sleeve.

16. A combustor apparatus comprising:

a first combustion chamber in a first combustor;

a second combustion chamber in a second combustor adjacent to the first combustor;

a cross-fire tube positioned between the first and second combustors to provide fluid communication between the first combustion chamber and the second combustion chamber; and a retention clip, the retention clip coupled to the cross-fire tube and configured to urge the cross-fire tube against an outer surface of a liner of the first combustor, wherein a portion of the retention clip conforms to a radially inner surface of a flow sleeve of the first combustor, further comprising a spring disposed about the cross-fire tube to provide retention of the cross-fire tube against the outer surface of the liner.

* * * * *